US008496297B2

(12) United States Patent
Huyck et al.

(10) Patent No.: US 8,496,297 B2
(45) Date of Patent: Jul. 30, 2013

(54) SEAT MECHANISMS

(71) Applicants: Benjamin N. Huyck, Chicago, IL (US); Kennoth C. Lundgreen, Algonquin, IL (US)

(72) Inventors: Benjamin N. Huyck, Chicago, IL (US); Kennoth C. Lundgreen, Algonquin, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 13/573,478

(22) Filed: Sep. 17, 2012

(65) Prior Publication Data

US 2013/0015685 A1 Jan. 17, 2013

Related U.S. Application Data

(62) Division of application No. 13/199,377, filed on Aug. 27, 2011, now Pat. No. 8,272,999, which is a division of application No. 12/076,587, filed on Mar. 20, 2008, now Pat. No. 8,021,278.

(60) Provisional application No. 60/920,753, filed on Mar. 29, 2007.

(51) Int. Cl.
*A47C 31/00* (2006.01)

(52) U.S. Cl.
USPC ..... 297/463.2

(58) Field of Classification Search
USPC ..... 297/215.13, 215.14, 195.11, 195.1, 297/463.2, 463.1; 482/57
See application file for complete search history.

(56) References Cited

U.S. PATENT DOCUMENTS

| | | | | |
|---|---|---|---|---|
| 6,612,970 | B2 * | 9/2003 | Forcillo | 482/57 |
| 6,913,560 | B2 * | 7/2005 | Ryan et al. | 482/51 |
| 7,364,533 | B2 * | 4/2008 | Baker | 482/57 |
| 7,708,251 | B2 * | 5/2010 | Watt et al. | 248/407 |

* cited by examiner

*Primary Examiner* — Milton Nelson, Jr.
(74) *Attorney, Agent, or Firm* — Michael B. McMurry

(57) ABSTRACT

Described are several mechanisms for permitting a user to adjust the seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat.

5 Claims, 18 Drawing Sheets

200
42
230
354
210
12
20

316
314
42
358
312
318
342
234
356
354
350
230
212
232
352
228
210
218
222
238
236
220
12

SEAT MECHANISMS

CROSS REFERENCE TO RELATED APPLICATIONS

This application is a divisional application of Ser. No. 13/199,377, filed on Aug. 27, 2011, now U.S. Pat. No. 8,272,999; which is a divisional application of Ser. No. 12/076,587. filed on Mar. 20, 2008, now U.S. Pat. No. 8,021,278: and claims priority on provisional application Ser. No. 60/920,753, filed on Mar. 29, 2007.

FIELD OF THE DESCRIBED MECHANISMS

The described mechanisms relate generally to exercise devices, and more particularly to seat mechanisms for use with stationary exercise bicycles.

BACKGROUND OF THE DESCRIBED MECHANISMS

Bicycling is recognized by the avid mountain and road cyclists riding on hilly or mountainous terrain or by the average or "Sunday" rider as a particularly effective type of aerobic exercise. Also, bicycling provides a low impact type of exercise which is especially easy on the knees and feet. As a result, stationary exercise bicycles facilitating this type of exercise are popular for both home and health club use.

With respect to operation of exercise bicycles, research has shown that the optimum position seating for bicycling is for the seat to be at a height that allows for approximately 15 degrees of leg bend when the rider's foot is at the lowest pedal position and for the seat post to be positioned rearwardly of the pedal crank and along a line passing through the pedal crank at an angle of approximately 71 degrees from the horizontal. Thus, the seat positioning requirements for optimum performance can vary greatly from rider to rider.

It has also been found that even slight movements of seat position will work either different muscles and/or different parts of the muscles. Typical seat position mechanisms provide only widely spaced adjustments which can limit the users ability to comfortably work different muscles.

In view of these issues and others, it is clear that a highly adjustable seat positioning system is needed, one that is easily controlled. The most common form of seat height adjustment involves using a pin, usually secured to the exercise bikes frame and often spring loaded, that is inserted into one of a number of holes in the seat post in order to position the seat. However, this arrangement has a number of disadvantages including the necessity of dismounting the bike to pull the pin out and because of the spacing of the holes on the post, the seat can only be positioned in increments that are on the order of one inch. One approach to solving this problem has been implemented on an exercise bicycle manufacture by Cybex Intl. of Medway, Mass. In this product, the seat post is configured with openings having a flap portion bent inwardly on the lower edge each of the openings which permit the user to pull the seat up to a new position without pulling the pin out. This arrangement provides a ratchet effect in that the flaps will guide the pin out of the openings while the seat post is moving up. However, it is still necessary for a user to manually pull the pin out to lower the seat. Also, the shape of the openings results in vertical seating increments of at least one inch. One approach to solving these problems is described in U.S. Pat. No. 6,913,560 where a rack is secured to the seat post and a latch mechanism including a release handle permits the seat to be lowered.

The desirability of fore and aft, or horizontal, adjustability has also been recognized. A number of "spin" type exercise bicycles produced by companies such as LeMond and Star Track employ mechanisms that allow the seat to be moved fore and aft. Typically, these mechanisms use screw type clamps to lock the seat in place. One example uses an assembly that mates with the seat post and slides fore and aft relative to a top plate on the seat post. A screw, having a knob attached and that mates with threads on the seat, is used to clamp the seat in position relative to the seat post. These types of mechanism have a number of disadvantages including being awkward for a user to use.

Seat adjustment capability is also desirable in recumbent type exercise bicycles. Typically, adjustment mechanisms on these types of machines permit the seat to move horizontally or at an angle with the horizon to accommodate users of different heights. As an example, Life Fitness, a division of Brunswick Corporation provides a recumbent exercise machine having a seat mounted for movement along a track where a handle attached to a spring loaded pin on one side of the seat is used in combination with a rack bolted to the side of the track to hold the seat in place.

SUMMARY OF THE DESCRIPTION

Described are a number of mechanisms that can allow for both vertical and horizontal positional adjustments to a stationary exercise bicycle seat in order to provide users with a convenient method of selecting a variety of seat positions.

DETAILED DESCRIPTION OF THE MECHANISMS

Figure 1:
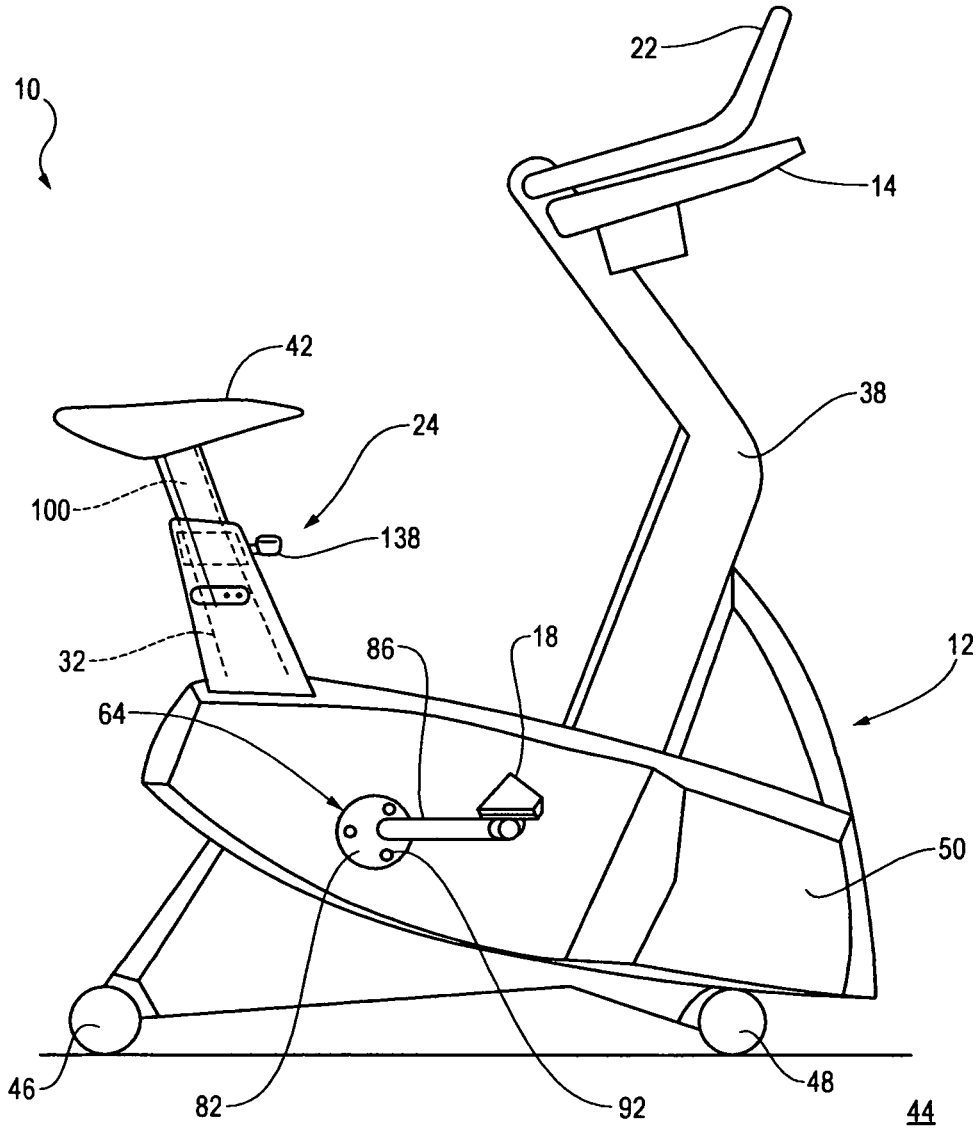
FIG. 1 is a side view of a first representative stationary exercise bicycle apparatus.

FIG. 1 depicts a first stationary exercise bicycle apparatus 10 that includes a tubular frame 12, a control panel 14, a drive assembly 16, a right pedal 18, a left pedal 20, handgrips 22 and a first embodiment of an adjustable seat mechanism 24. The frame 12 acts as the supporting structure for the stationary exercise bicycle apparatus 10 and can be of any suitable construction. It should also be understood that a variety of different frame structures can be used to support the elements of the apparatus 10 such as the frames used in the current existing stationary exercise bicycles. In the illustrated preferred embodiment, the frame 12 includes a rear cross member 26, a front cross member 28, a slightly bent longitudinal support member 30 secured to and between the rear cross member 26 and the front cross member 28, a first vertical support member 32 secured to the longitudinal support member 30, a bracing member 34 secured to and between the longitudinal support member 30 and the first vertical support member 32, a horizontal support member 36 secured to the first vertical support member 32, a second vertical support member 38 secured to the horizontal support member 36, a second support member 40 secured to and between the horizontal support member 36 and the longitudinal support member 30, and a central horizontal support member 41 secured to and between the first vertical support member 32 and the second support member 40. The first vertical support member 32 provides support for the adjustable seat mechanism 24 and a seat 42. The second vertical support member 38 provides support for the control panel 14 and the handgrips 22.

The rear cross member 26 and the front cross member 28 are configured for placement on a floor 44. Levelers 46 are provided on the rear cross member 26 so that if the floor 44 is uneven, the rear cross member 26 can be raised or lowered such that the rear cross member 26, the longitudinal support member 30 and the front cross member 28 are substantially level. Rollers 48 are provided on the front cross member 28 so that the stationary exercise bicycle apparatus 10 can be easily moved from one location to another.

The stationary exercise bicycle apparatus 10 also includes a right housing shown at 50 and a similar left housing 51 to protect and shield from view the internal components of the stationary exercise bicycle apparatus 10. As is the case with most exercise bicycles, centrally locating the internal components, essentially between the legs of the user, provides for stability and allows for a lightweight and simple design.

It should be noted that the exercise bicycle 10 as described above is representative of a large array of existing stationary exercise bicycles and is used to provide the preferred environment for the seat mechanisms described herein.

FIGS. 2-8 depict the preferred structure of the first embodiment of the adjustable seat mechanism 24. Although, the seat mechanism 24 can be used with many different types of exercise bicycles, as well as other types of exercise equipment, for convenience it is described herein within the context of the stationary bicycle 10. As previously described, the first vertical support member 32 of the frame 12 provides support for the adjustable seat mechanism 24. In this embodiment, a seat post or tube 93 for supporting the seat 42 is configured to move up and down within the first vertical support member 32. The seat post 93 is configured with a channel 94 and also slides up and down within a collar member 96 which in turn is secured to the upper portion of the first vertical support member 32. The vertical support member 32 also includes an aperture 98 for receiving a portion of the seat mechanism 24.

Figure 6:
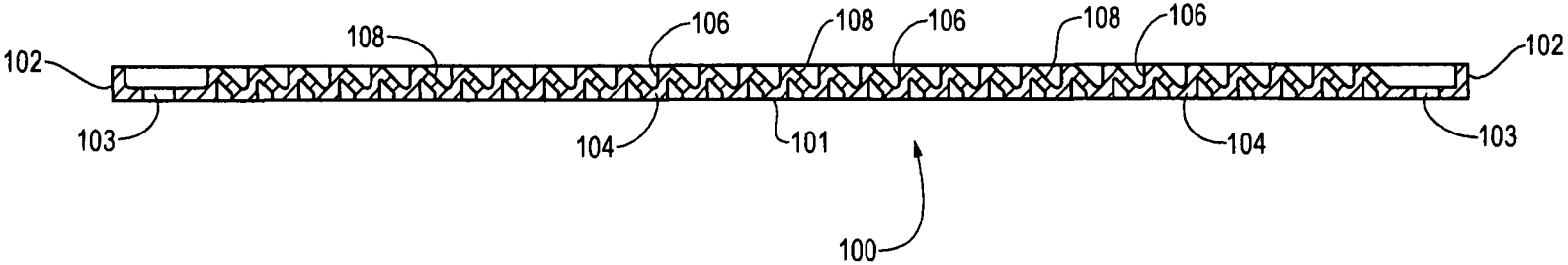
FIG. 6 is a sectioned side view of the rack mechanism taken along the direction indicated by a line 6-6 as shown in FIG. 5.
Figure 7:
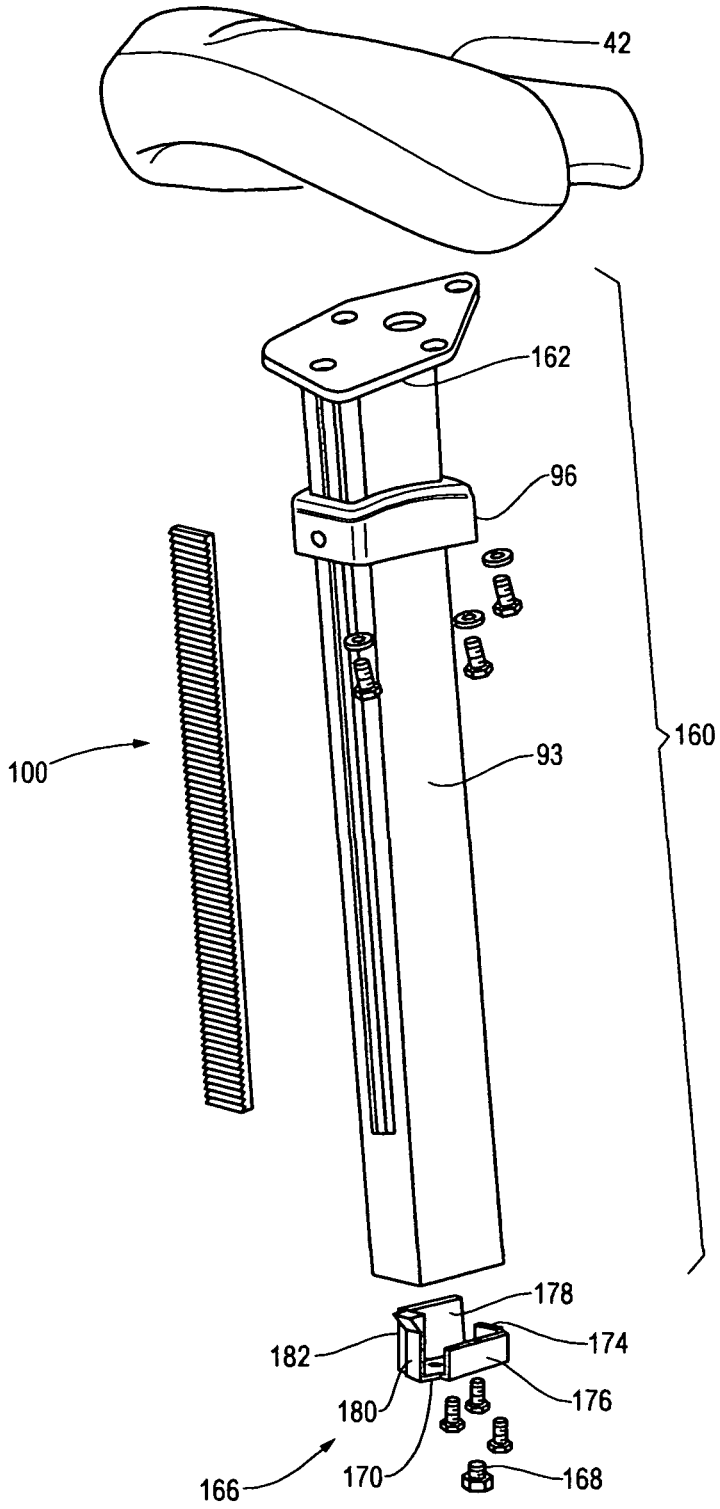
FIG. 7 is a rear perspective view of a seat post for use with the adjustable seat mechanism of FIGS. 1 and 2-6.
Figure 8:
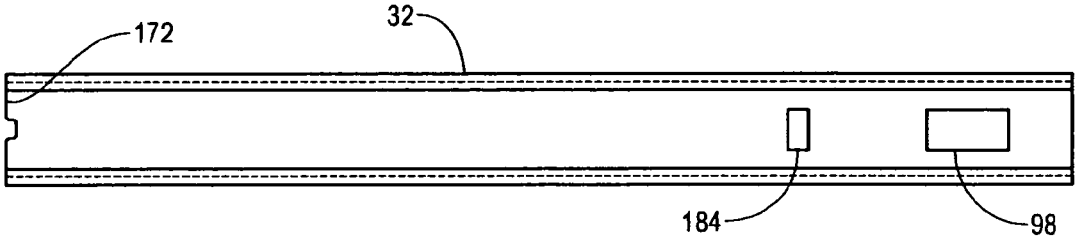
FIG. 8 is a rear view of a vertical seat post support member for use with the adjustable seat mechanism of FIGS. 1-7.

A rack 100 is disposed within the channel 94 formed in the seat post 93. With reference to FIGS. 7 and 8, the rack 100 includes an elongated central portion 101 with semi-circular end portions 102 having apertures 103 for receiving fasteners (not shown) for securing the rack 100 to the seat post 93 in the channel 94. It should be noted that the rack 100 can be secured to the seat post 93 by a variety of methods including welding to the seat post 93 or made integral with the seat post 93. The rack 100 includes a large number of closely spaced teeth 104. As shown in FIG. 6, each of the teeth 104 includes a horizontal surface 106 and an angled surface 108. Because a large number of closely spaced teeth 104 are used on the rack 100, it is possible to provide a large number of vertical positions of the seat 42.

Figure 3:
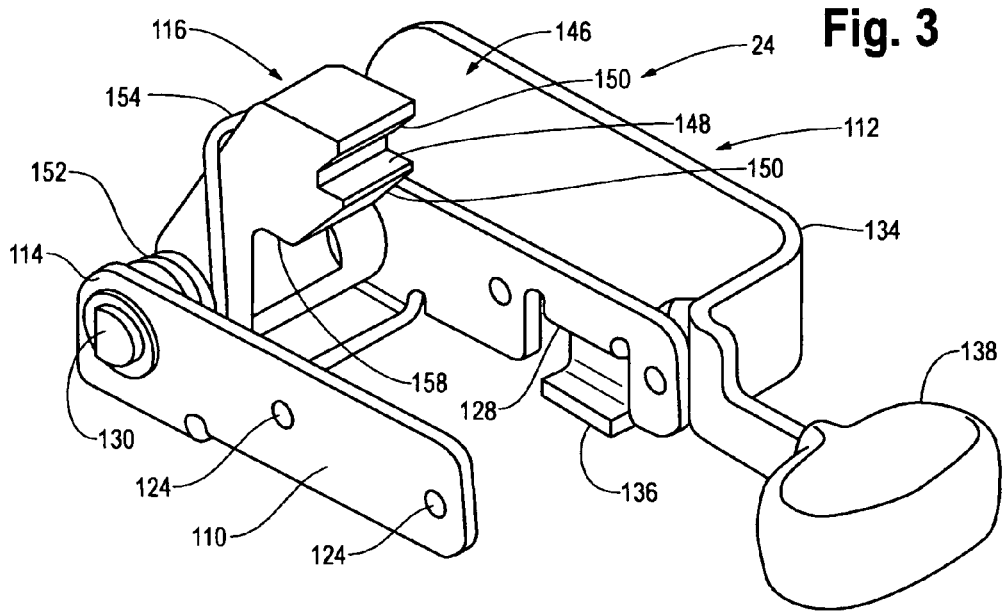
FIG. 3 is a right side perspective view of the adjustable seat mechanism shown in FIG. 2.
Figure 4:
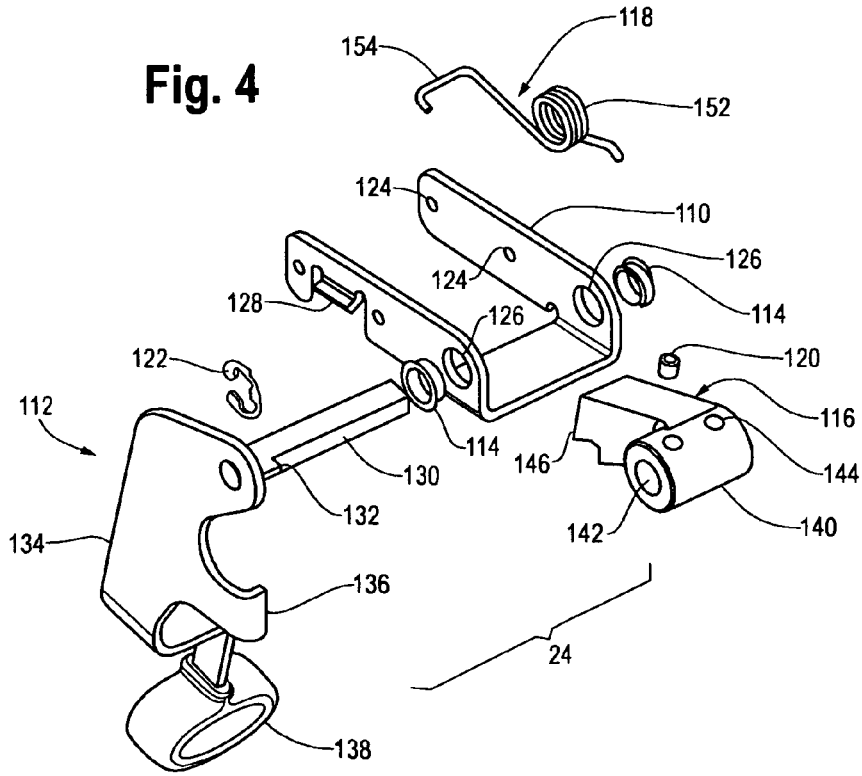
FIG. 4 is an exploded view of the adjustable seat mechanism shown in FIGS. 1, 2 and 3.
Figure 5:
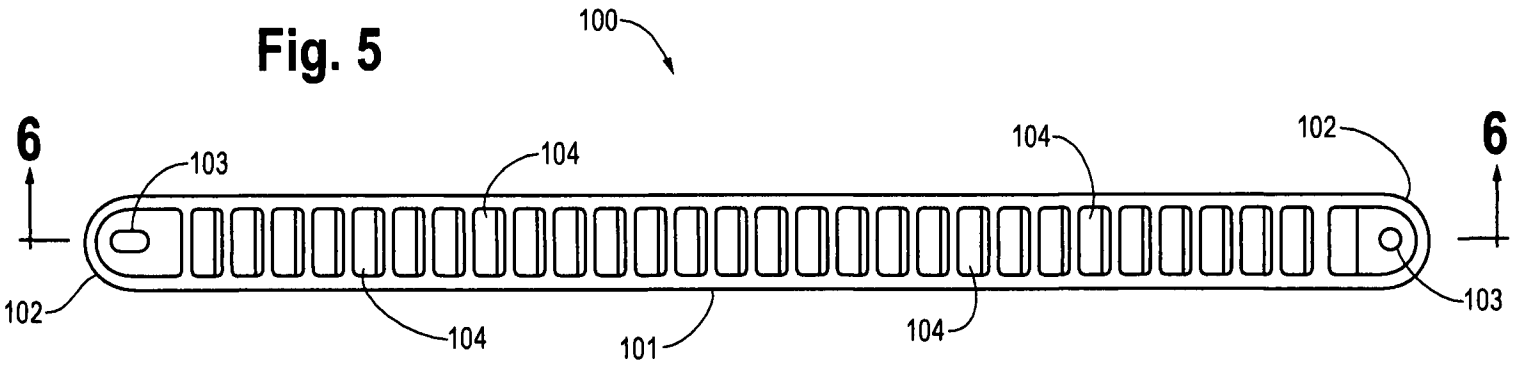
FIG. 5 is a top view of a rack mechanism for use with the adjustable seat mechanism shown in FIGS. 1 and 2-4.

As illustrated in FIGS. 3 and 4 in detail, the latching portion of the adjustable seat mechanism 24 includes a U-shaped latch support bracket 110, a link shaft assembly 112, bushings 114, a latch member 116, a latch spring 118, retaining screws 120 and a retaining ring 122. The U-shaped bracket 110 includes apertures 124 and 126 formed therein, and a detent or stop 128. The link shaft assembly 112 includes a shaft 130 having flat surfaces indicated at 132, a stepped bracket 134 having a tab portion 136 and a latch release handle 138. The latch member 116 includes a cylindrical portion 140 having a bore 142 formed therethrough and apertures 144 formed therein for receiving the retaining screws 120, and a rack engagement portion 146. The rack engagement portion 146 is configured with a normally horizontal flat surface 148 and a pair of angled surfaces 150. The latch spring 118 includes a circular portion 152 and a L-shaped portion 154.

With continued reference to FIGS. 3 and 4, the retaining ring 122, the bushings 114, the latch member 116 and the latch spring 118 are secured to the shaft 130 of the link shaft assembly 112. Accordingly, the shaft 130 of the link shaft assembly 112 extends through the apertures 126 formed in the U-shaped bracket 110, through the bore 142 formed through the tubular portion 140 of the latch member 116 and through the circular portion 152 of the latch spring 118. While mounted on the shaft 130, the L-shaped portion 154 of the spring latch 118 engages the latch member 116. The torque screws 120 are inserted through the apertures 144 formed in the tubular portion 140 of the latch member 116 and engage the flat surface 132 of the shaft 130 to keep the latch rack 116 properly positioned on the shaft 130. Similarly, the retaining ring 122 and the bushings 114 aid in keeping the above described assembly in proper position.

Figure 2:
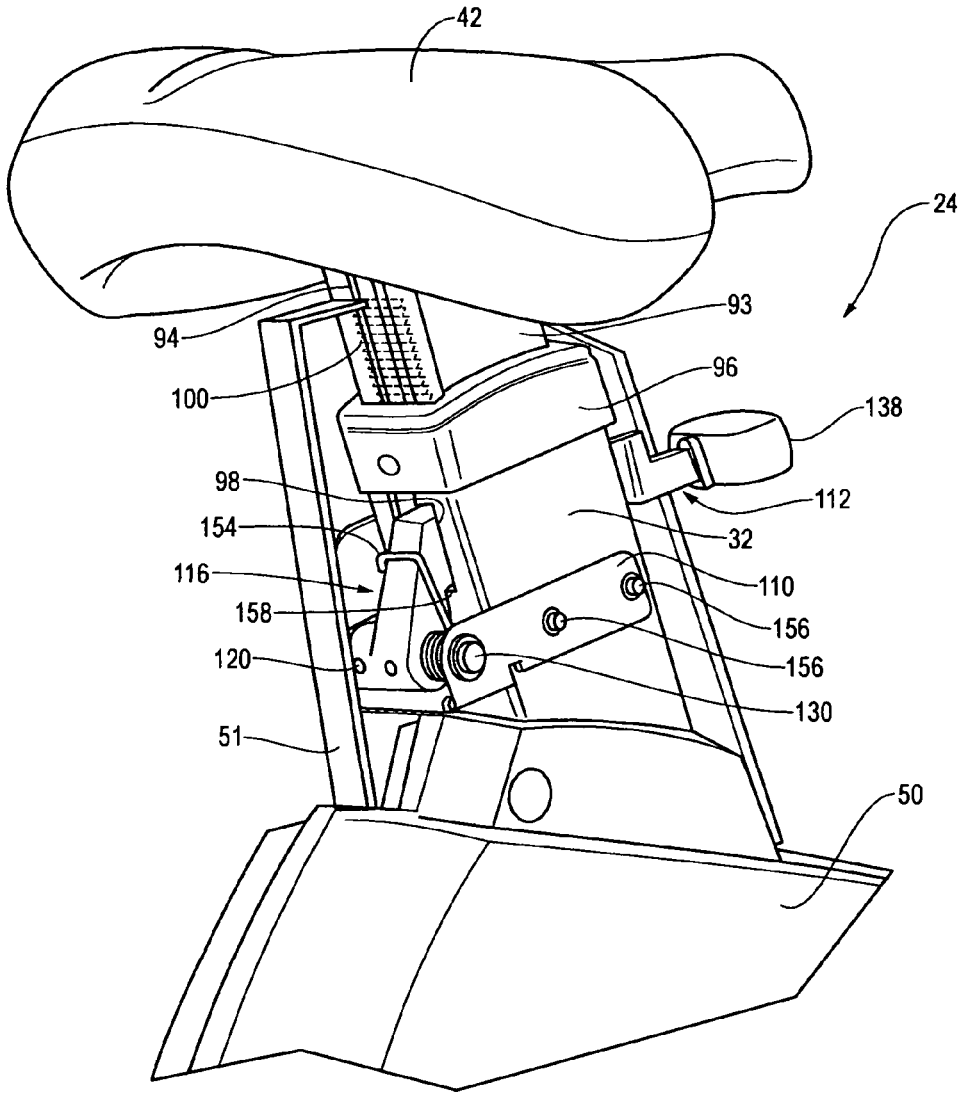
FIG. 2 is a right side perspective view of a first adjustable seat mechanism for use with the stationary exercise bicycle apparatus in FIG. 1.

The adjustable seat mechanism 24 can be mounted to the support member 32 by any suitable mounting means. An example of such is illustrated in FIG. 2 wherein a set of self tapping screws 156 are inserted through the apertures 124 formed in the U-shaped bracket 110. When mounted on the seat post support member 32, the latch member 116 extends through the aperture 98 formed in the support member 32. The lower edge of the aperture 98 serves to support a lower flat surface 158 of the latch member 116 thereby supporting the weight of the post tube 93 along with the weight of the user on the seat 42. As a result of the geometry of this combination of the latch member 116, the rack 100 and the lower edge of the aperture 98, this mechanism becomes a self locking mechanism where the latching or locking effect becomes greater with increasing load on the seat 42.

FIG. 7 in connection with FIG. 8 illustrates the preferred embodiment of a seat post assembly 160. This assembly 160 as shown in FIG. 7 includes the seat post 93, the rack 100 and the collar 96. In addition the seat post assembly 160 includes a plate 162 for supporting the seat 42 and a guide base 166. The guide base 166 fits over the bottom of the seat post 93 and is preferably a one piece molded plastic part. A polyelastomer bumper 168 is secured to the bottom portion 170 of the guide base 166 in order to cushion the impact of the seat post 93 on a bottom surface 172 of the seat post support 32 shown in FIG. 8 when the seat post 93 is moved to its lowest position in the support 32. Integral with the bottom portion 170 of the guide base 166 are a pair of vertical bearing surfaces 174 and 176 along with a pair of stabilizer arms 178 and 180. The stabilizer arms 178 and 180 are configured so as to be compressed inwardly when the guide base is inserted into the seat post support 32 and operate in combination with the bearing surfaces 174 and 176 to provide for smooth movement of the lower part of the seat post 93 in the support 32. In addition, the stabilizer arm 180 includes an outward projection or stop 182 that is configured to engage an aperture 184 configured in the seat post support member 32 as shown in FIG. 8. This will prevent a user from inadvertently pulling the seat post 93 out of the support 32 when lifting the seat 42.

The adjustable seat mechanism 24 functions as a ratchet mechanism. Normally, as discussed above, when the user is on the seat 42, the seat 42 is locked against downward movement as the flat surface 148 of the tooth portion 146 of the latch 116 is engaged with the horizontal surface 106 of two of the teeth 104 of the rack 100 and as the surface 158 abuts the lower edge of the aperture 98. The spring 118 tends to bias the release handle 138 in a downward direction into its normal position. If the user desires to raise the seat 42, the user simply pulls the seat upward, causing the seat mechanism 24 to ratchet upward. During this upward ratcheting, the angled surfaces 150 of the tooth portion 146 of the latch 116 simply slide over the next lower angled surface 108 of the teeth 104 of the rack 100. When the desired vertical position is achieved, the seat 42 will be locked in place as previously described above. If the user desires to lower the seat 42, the user simply pulls up on the release handle 138 of the link shaft assembly 112 causing the latch 116 to rotate to the rear on the shaft 130 overcoming the biasing force of the spring 118, which in turn, causes the flat surfaces 148 of the tooth portion 146 of the latch member 116 to disengage from the horizontal surfaces 106 of the teeth 104 of the rack mechanism 100. The tab portion 136 of the link shaft assembly 112 serves to limit the amount of upward movement of the handle 138 by abutting against the detent stop 128 formed in the U-shaped bracket 110. Once the desired vertical position is achieved, the handle 138 is released, whereupon the spring 118 will cause the latch member 116 to rotate forward and the seat 42 is locked in place as previously described.

Accordingly, the adjustable seat mechanism 24 allows the user to select the optimum seat position since the closely spaced teeth 104 permit a fine height adjustment for the seat 42 of about one half inch. The seat mechanism 24 also provides the user with a particularly convenient method for seat height adjustment. All that is necessary to raise the seat 42 is to simply pull it up. And to lower it, all that is necessary is to lift the release handle 138 up to disengage the latch member 116 from the rack 100. In addition to the relatively fine seat adjustment, this mechanism 24 has the advantage of allowing a user to adjust the seat 42 both up and down by merely standing on the pedals 18 and either pulling the seat 42 up or using the release handle 138 to lower the seat 42. It is not necessary for the user to get off the apparatus 10 to pull a pin as in other types of seat adjustment mechanisms.

Figure 9:
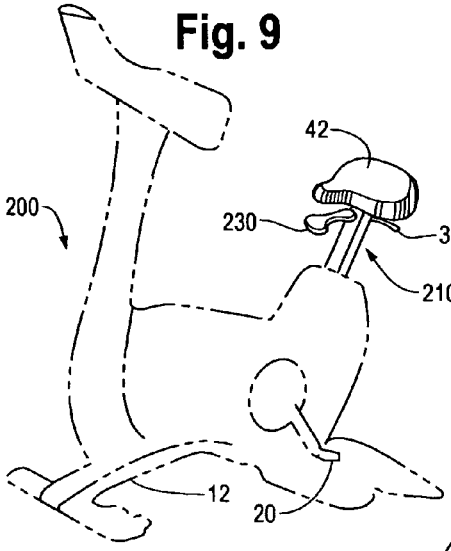
FIG. 9 is a left perspective side view of a second representative stationary exercise bicycle apparatus.

FIG. 9 depicts a second stationary exercise bicycle apparatus 200 that includes many of the basic structural elements of the first stationary bicycle 10 including the control panel 12 and the right and left pedals 18 and 20 as well as the seat 42. However, instead of the first embodiment of the seat mechanism 42 described above, the bicycle 200 includes for descriptive purposes a pair of adjustment mechanisms indicated generally at 210 that can permit a user to adjust the seat in both the vertical, up and down, direction and the horizontal, fore and aft direction. Although preferable, it is not necessary that and exercise bicycle use both the horizontal and the vertical adjustments.

Figure 14:
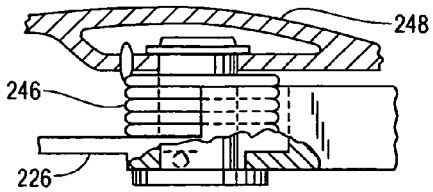
FIG. 14 is partial sectioned top view illustrating a the latch arrangement portion of the mechanism of FIG. 13 taken along a section line 14-14 of FIG. 13.
Figure 15:
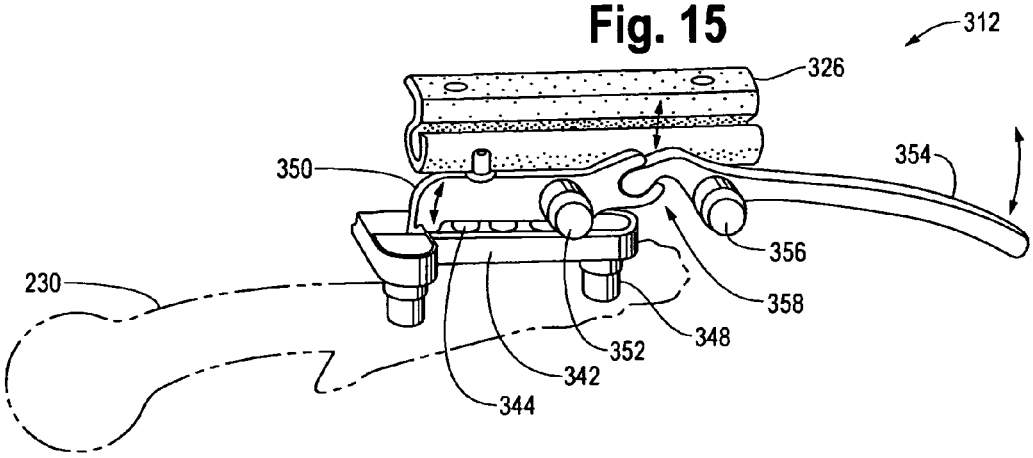
FIG. 15 is a partial sectioned left view of portions of the horizontal seat adjustment mechanism of FIG. 10.
Figure 16:
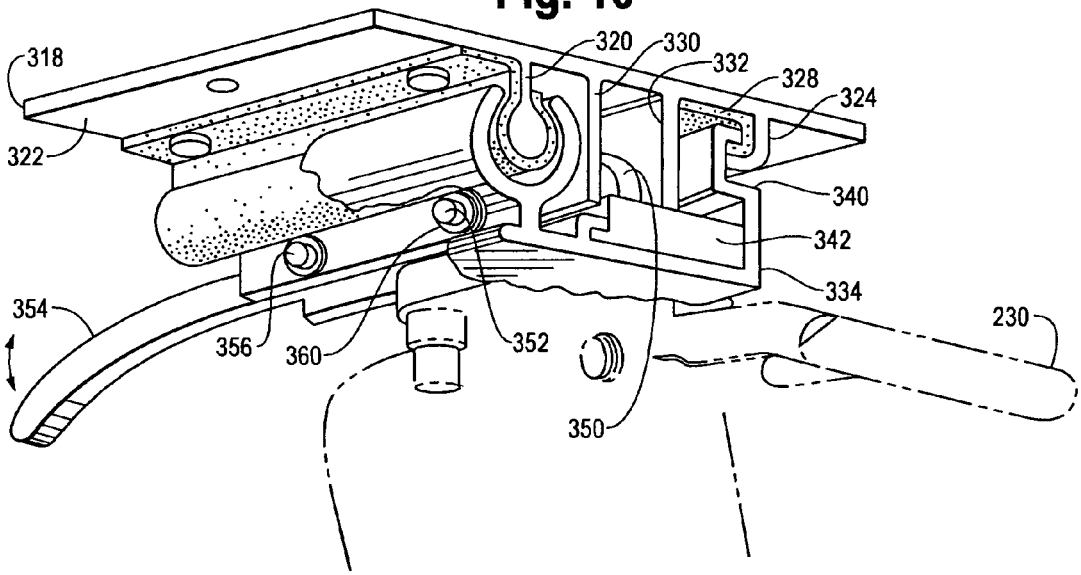
FIG. 16 is a partial sectioned right perspective view of a portion of the horizontal seat adjustment mechanism of FIG. 10.
Figure 17:
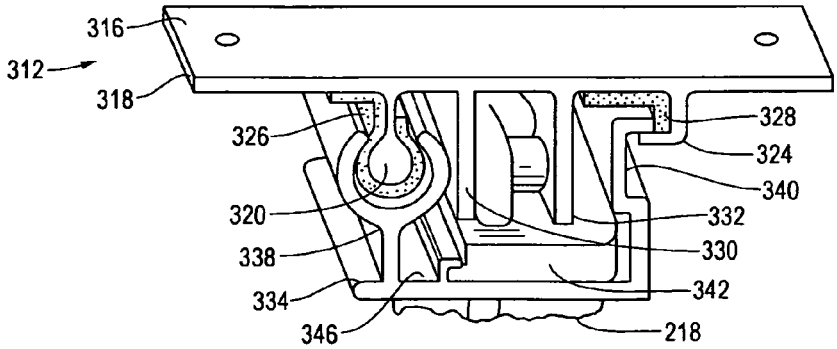
FIG. 17 is a partial sectioned front perspective view of a portion of the horizontal seat adjustment mechanism of FIG. 10

FIGS. 9-14 illustrate the preferred embodiment of a vertical seat mechanism indicated generally at 212 for use on an upright type stationary exercise bicycle of the type 200. In this embodiment of the vertical mechanism 212, the seat is attached to a plate 214 by a number of fasteners 216 that in turn is connected to a seat post 218. Preferably, the seat post 218 is an aluminum extrusion configured to slide up and down in a vertical support tube 220 secured to the frame 12. Attached to the rear side of the support tube 220 is a rack 222. Secured within the seat post 218 is a latch mechanism indicated generally at 224 that, in the preferred embodiment, includes a latch member 226, a connecting rod 228 and a release handle 230. The release handle 230 is pivotally attached to the rearward end of the seat post 218 via a pin 332; the connecting rod 228 is pivotally connected to the mid portion of the release handle 230 via a pin 234; and the latch member 226 is pivotally connected to the connecting rod 228 via a pin 236 and pivotally connected at its mid portion to the seat post 218 via a latch pivot pin or axel 238 that in turn is secured to the seat post 218. In this embodiment of the seat mechanism 212, the rack 222 is configured with a set of teeth 240 each including an engagement surface 242 that is configured to abut an engagement surface(s) indicated by 244 on the latch member 226. As shown in FIG. 14, a torsion spring 246 can be used to bias the latch member such that it maintains engagement with the teeth 240. The latch pivot axel 238 is supported on the seat post 218 by a mounting structure a portion of which is shown at 248 in FIG. 14.

To operate the seat mechanism 212, a user can pull up on the handle 230 which will pivot about the pin 232 thereby causing the connecting rod 228 to lift and rotating the latch member 226 out of engagement with the teeth 240 on the rack 222. The seat post 218 is then free to move down in the support tube 222 under the weight of the user. In this manner the user can lower the seat 42 by simply lifting the handle 230. When the handle is released, the spring 246 will cause the latch member 226 to return to engagement with the teeth 240 on the rack 222 thereby preventing the seat post 218 and hence seat 42 from sliding down in the support tube 220. To raise the seat 42, the user need only lift upwardly on the seat 42 because the teeth 240 are configured to cooperate with the latch member 226 so as to operate as a ratchet mechanism in the upward direction.

Figure 10:
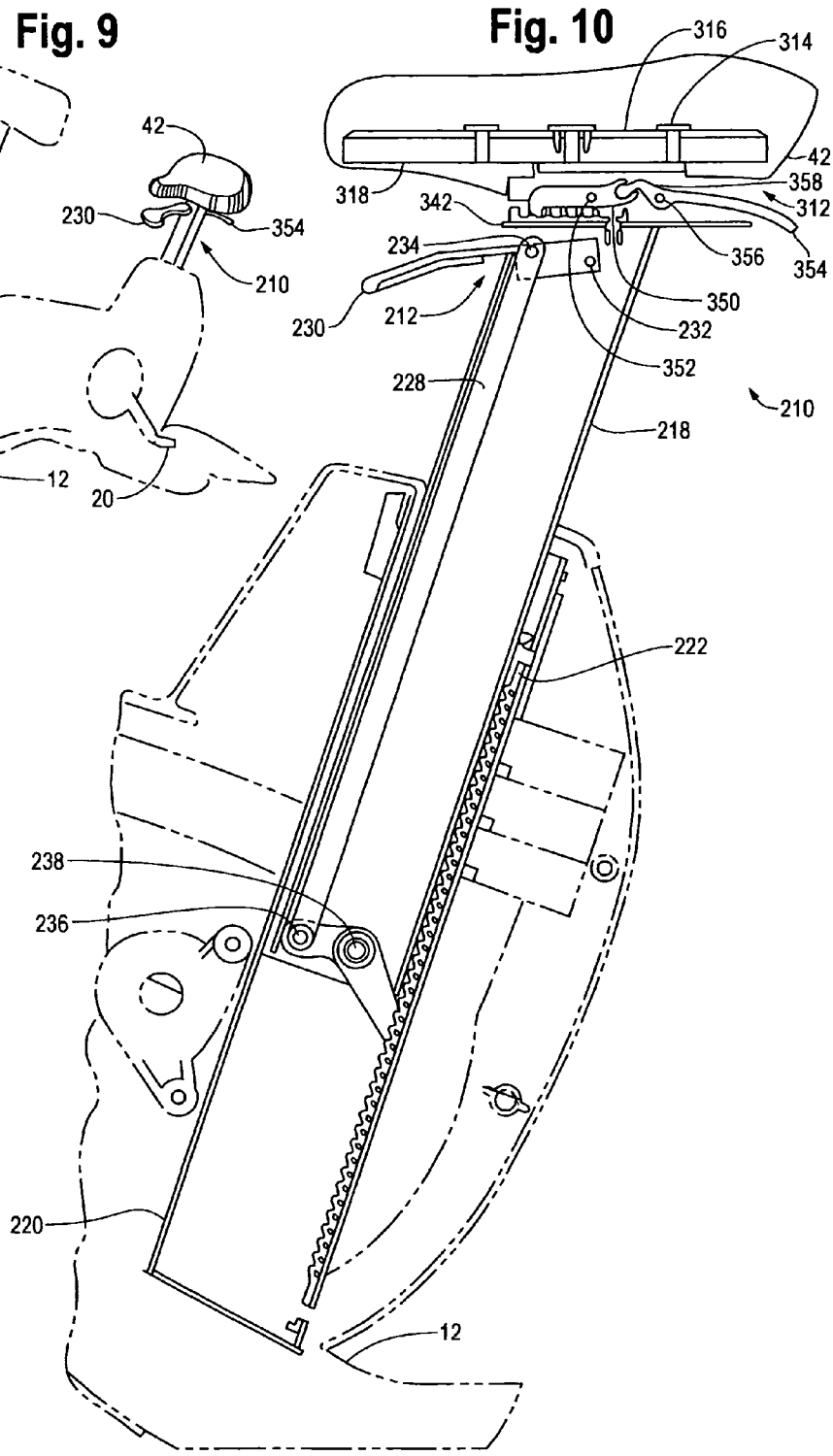
FIG. 10 is a left sectioned side view of mechanisms for adjusting a seat vertically and horizontally for use with the stationary exercise bicycle apparatus in FIG. 9.
Figure 11:
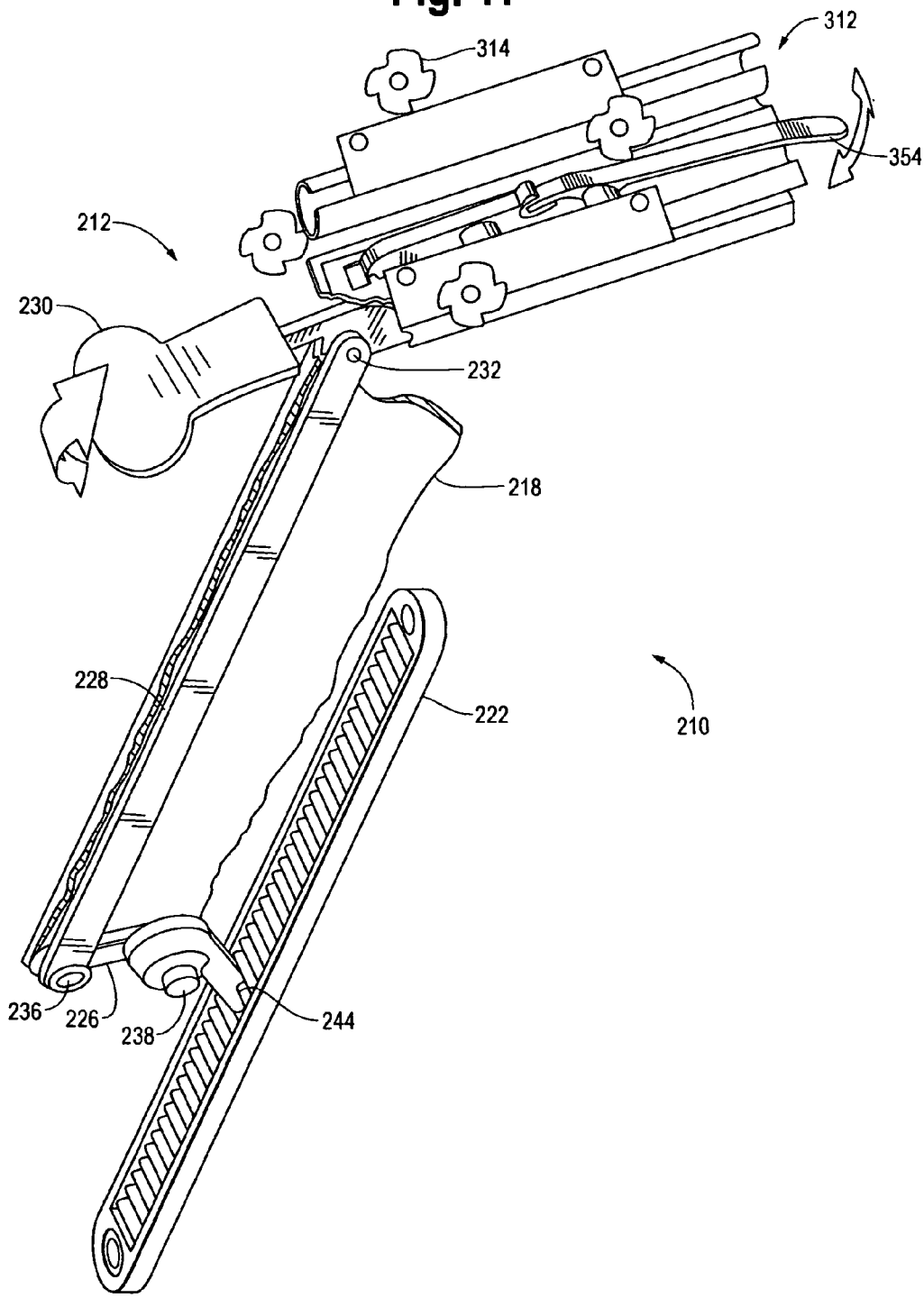
FIG. 11 is a top perspective view illustrating portions of the mechanisms of FIG. 10.
Figure 12:
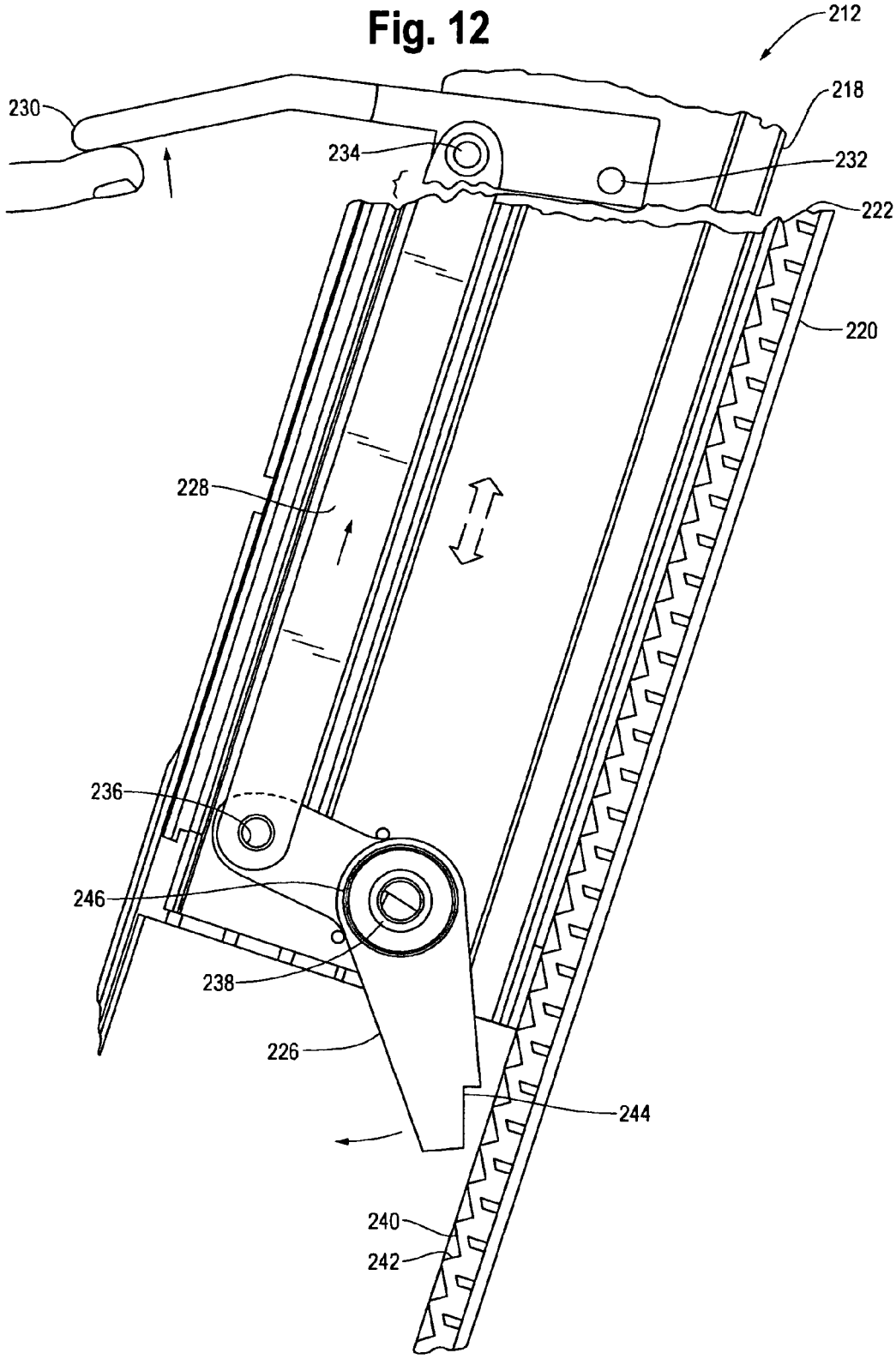
FIG. 12 is a left section view illustrating portions of the latch arrangement for the horizontal mechanisms of FIG. 10.
Figure 13:
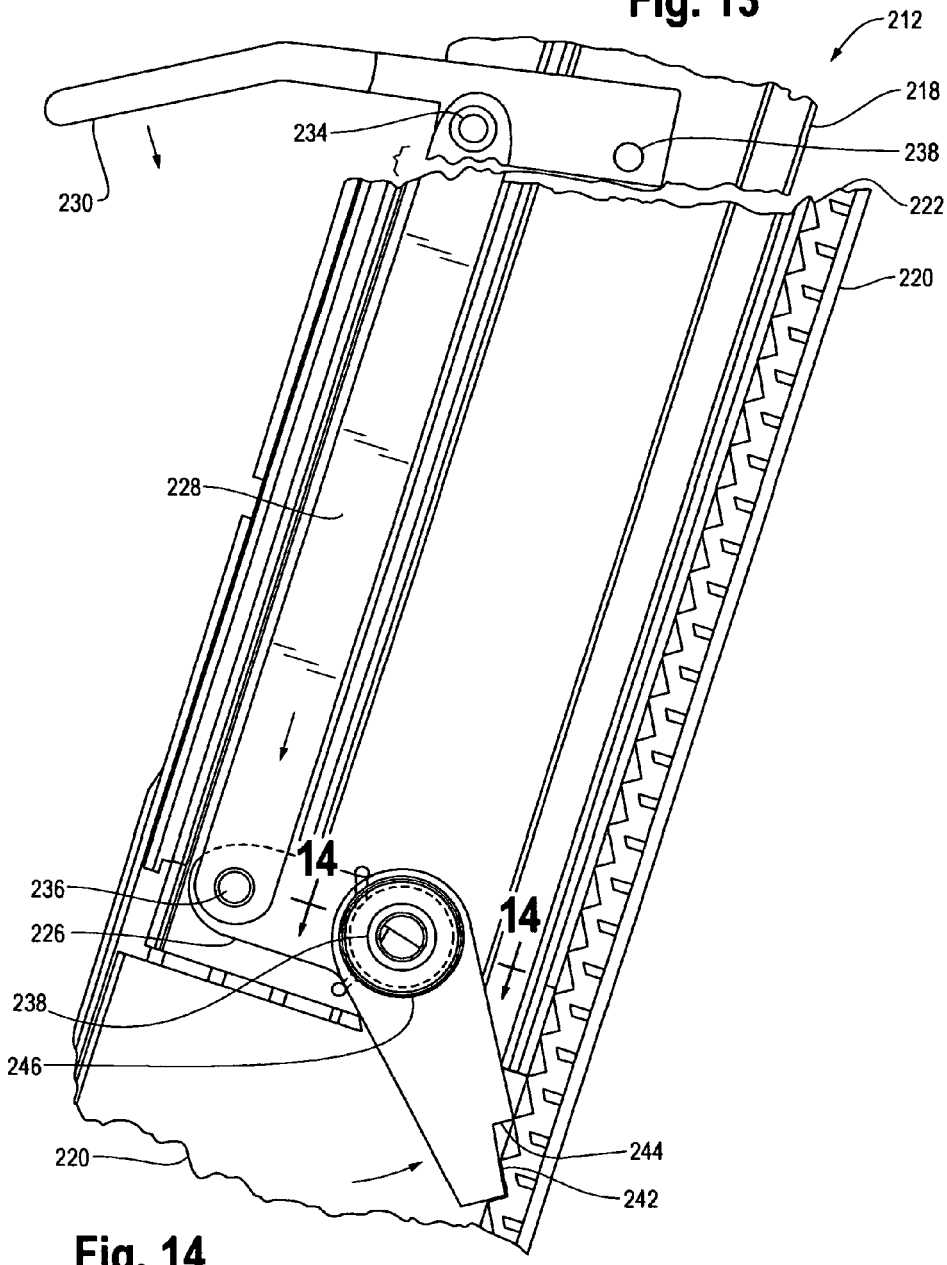
FIG. 13 is a partial left section view illustrating portions of the latch arrangement for the horizontal mechanisms of FIG. 12.

FIGS. 15-19 along with FIGS. 10 and 11 illustrate the preferred embodiment of a horizontal seat mechanism indicated generally at 312 for use on an upright type stationary exercise bicycle of the type 200. In this embodiment the seat 42 is secured by a number of fasteners, indicated by 314, to an upper planar surface 316 of a slidable seat support 318. The seat support 318 is configured with a right slide member 320 having a generally circular cross section extending downwardly from a lower planar surface 322 and a left slide member 324 configured generally as a lip also extending downwardly from said lower planar surface 322. In addition, a first bearing material 326 encompasses the right slide member 320 and a second bearing material 328 covers the interior surface of the left slide member 324. A pair of downward axel support extensions 330 and 332 is also configured into the seat support 318. Secured to the top of the seat post 218 is a stationary receiving structure 334. Configured on the right side of the receiving structure 334 is a tubular portion 338 sized to receive the right slide member 320 and its bearing material 326 and configured on the left side of the receiving structure 334 is u-shaped portion 340 sized to receive the left slide member 324 and its bearing material 328. This arrangement permits the seat support 318 and the seat to move fore and aft along the top of the seat post 218.

Figure 18:
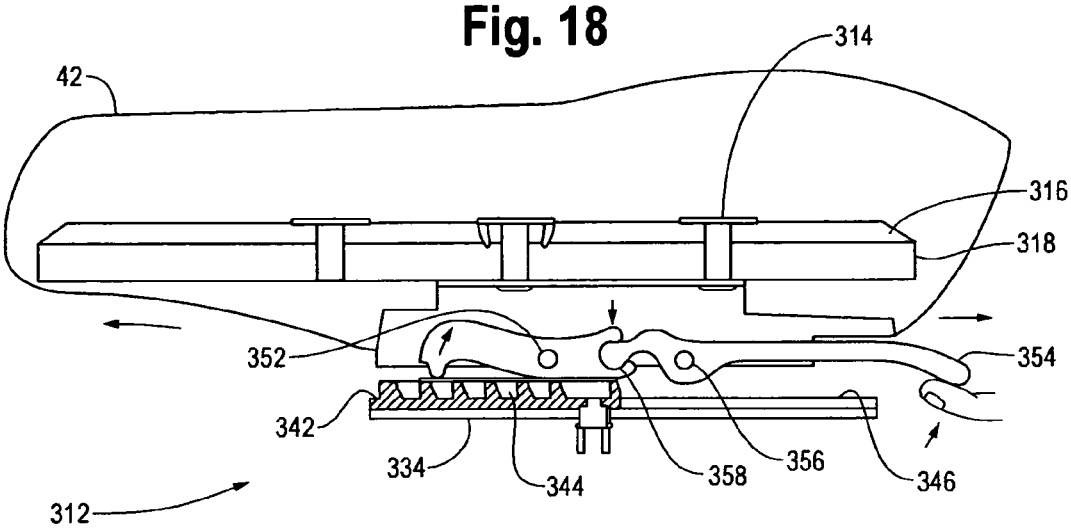
FIG. 18 and FIG. 19 are partial sectioned right views illustrating the operation of the latch mechanism of the horizontal seat adjustment mechanism of FIG. 10.
Figure 19:
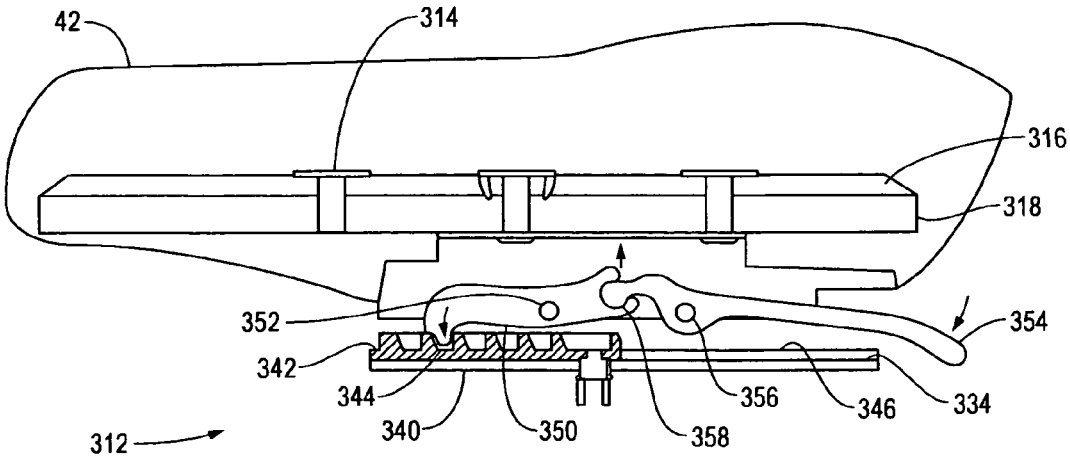

To retain the position of the seat 42 on the seat post 218, a rack 342 having a set of essentially rectangular shaped teeth 344 is mounted on an upper surface 346 of the receiving structure 334 by a set of fasteners indicated at 348. A pawl 350 rotatably mounted on the brackets 330 and 332 by a shaft 352 is configured to engage the teeth 344. Operatively connected to the pawl 350 is a handle 354 that is also rotatably mounted on the brackets 330 and 332 by a shaft 356. A ball and socket type arrangement 358 serves to connect the handle 354 to the pawl 350 such that when the handle 354 is pulled up by a user, the ball and socket type assembly 358 rotates down on the pivots or axels 352 and 356 thus disengaging the pawl 350 from the rack 342. When the pawl 350 is disengaged from the rack 342, the slidable seat support 318 is free to move horizontally along the receiving structure 334 across the top of the seat post 218 thereby providing a fore and aft adjustment capability for the seat 42. One approach to prevent the seat 42 from moving fore and aft after the handle 354 has been released, is to provide biasing mechanism such as a torsion spring attached to one or the other shafts 352 or 356 as indicated by 360 in order to apply a bias force to the pawl 350 urging it back into the rack 342. Operation of the seat mechanism 312 is illustrated in FIG. 18 where the handle 354 has been lifted upward disengaging the pawl 350 from the rack 342 and in FIG. 19 where the handle has been released causing the pawl 350 to reengage the rack 342.

Figure 20:
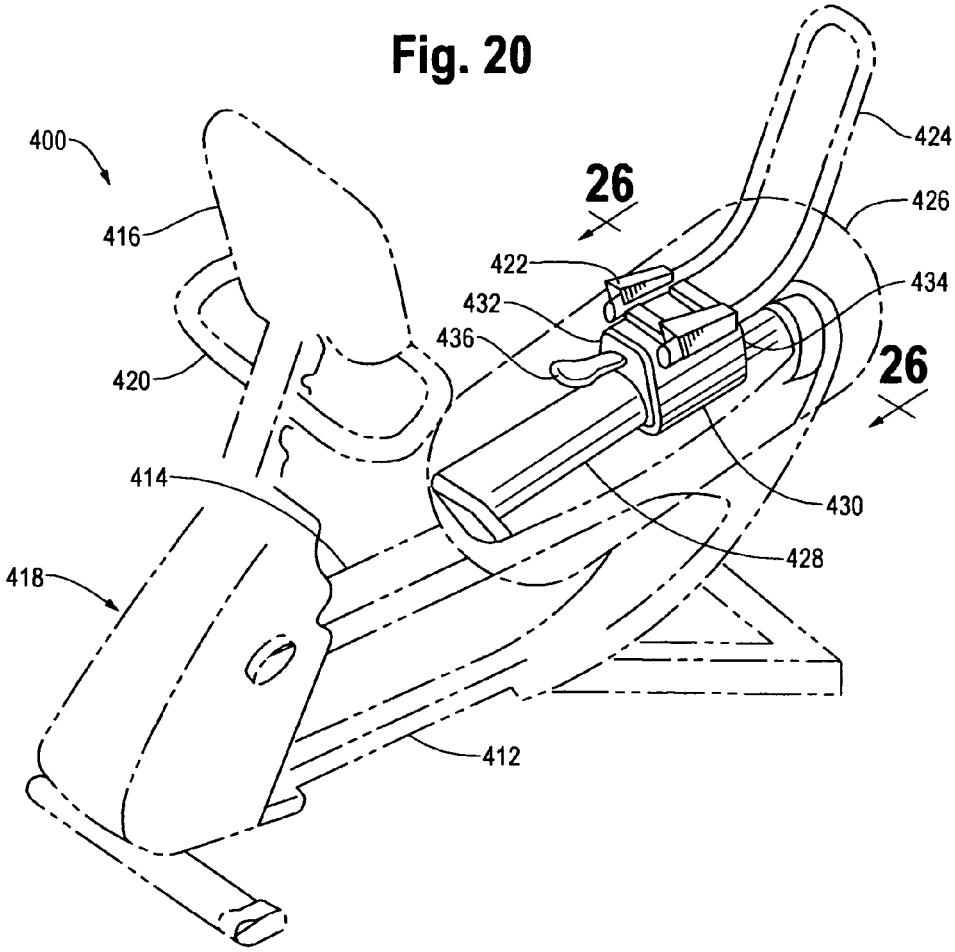
FIG. 20 is a perspective view of a representative recumbent exercise bicycle apparatus.
Figure 26:
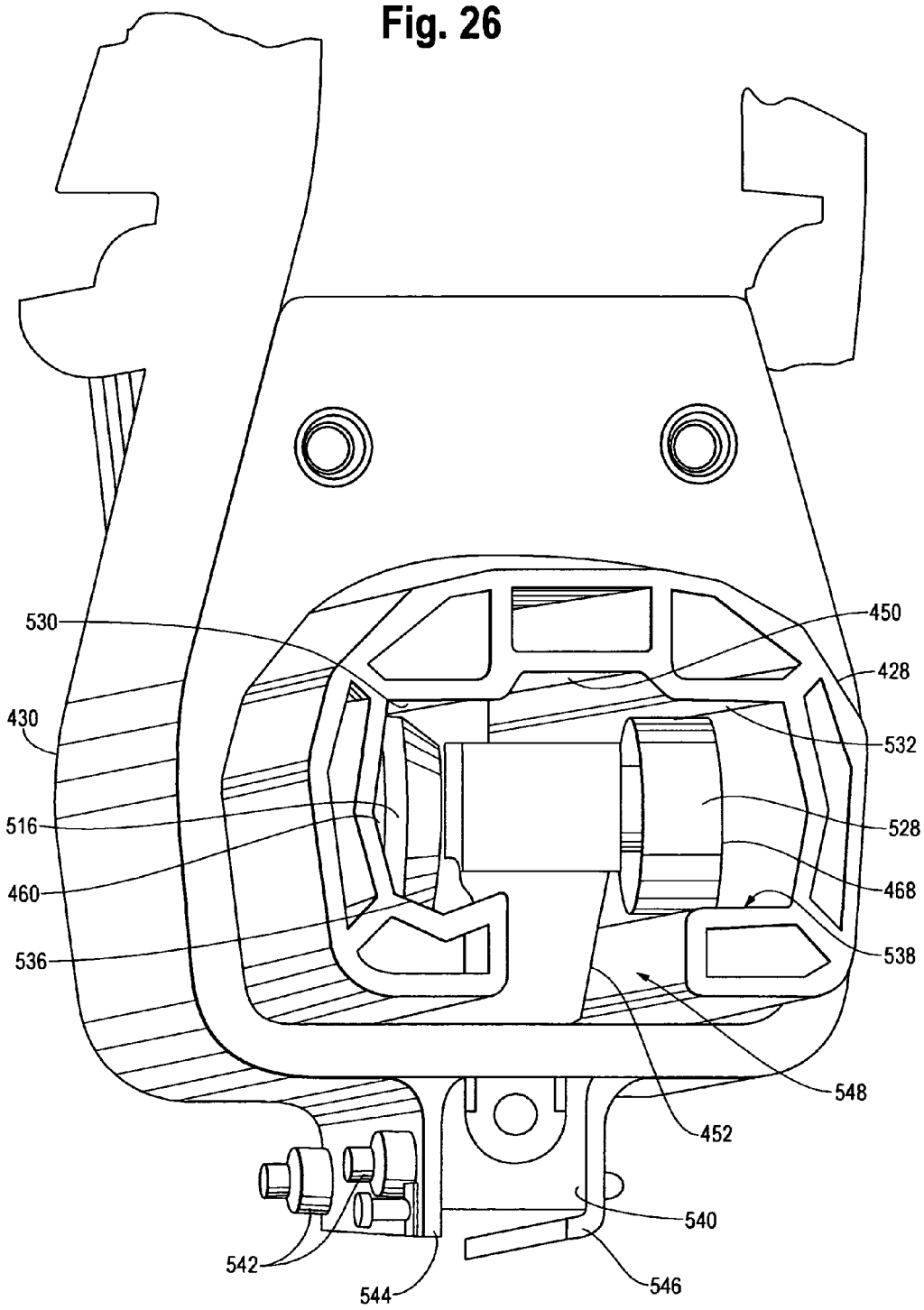
FIG. 26 is partial sectioned back view illustrating a carriage support arrangement portion of the seat mechanism of FIG. 20 taken along a section line 26-26 of FIG. 20.

FIG. 20 depicts a representative recumbent type exercise bicycle 400 with typical recumbent components indicated in dashed line that include, for example, a frame 412 having a central support member 414, a control panel 146, a drive assembly generally indicated at 418, a handgrip 420, a seat support frame 422 for supporting a seat (not shown) and a back rest support frame 424 for supporting a back rest (not shown). Also shown in FIG. 20 is a preferred embodiment of an adjustable seat mechanism as indicated within the line 426. The seat mechanism 426 includes: a carriage support member 428 mounted on the frame 412 on top of the central support member 414, a cross section of which is depicted in FIG. 26; a carriage housing 430 attached to the seat support frame 424; a pair of support brackets 432 and 434 encompassing the carriage support member 428 and attached to each end of the carriage housing 430; and a latch release handle 436.

Figure 21:
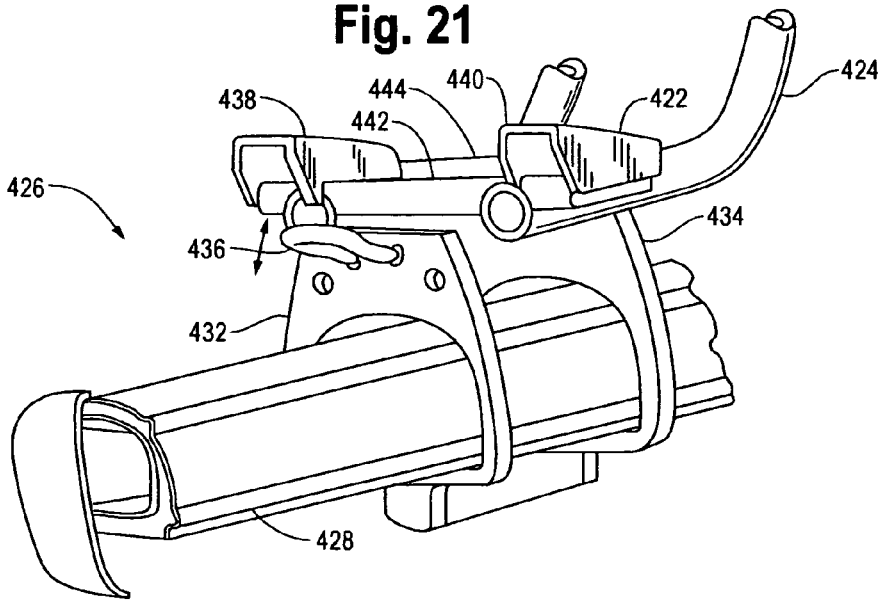
FIG. 21 is a left perspective view of a seat mechanism for use with the recumbent apparatus of FIG. 20.

FIG. 21 shows in some more detail the outer portions of the seat mechanism 426 without the carriage housing 430. In this embodiment, the seat support frame 422 includes a pair of longitudinal members 438 and 440 to which the seat can be attached and a pair of lateral members 442 and 444 secured to the longitudinal members 438 and 440 as well as to the backrest support frame 424.

Figure 22:
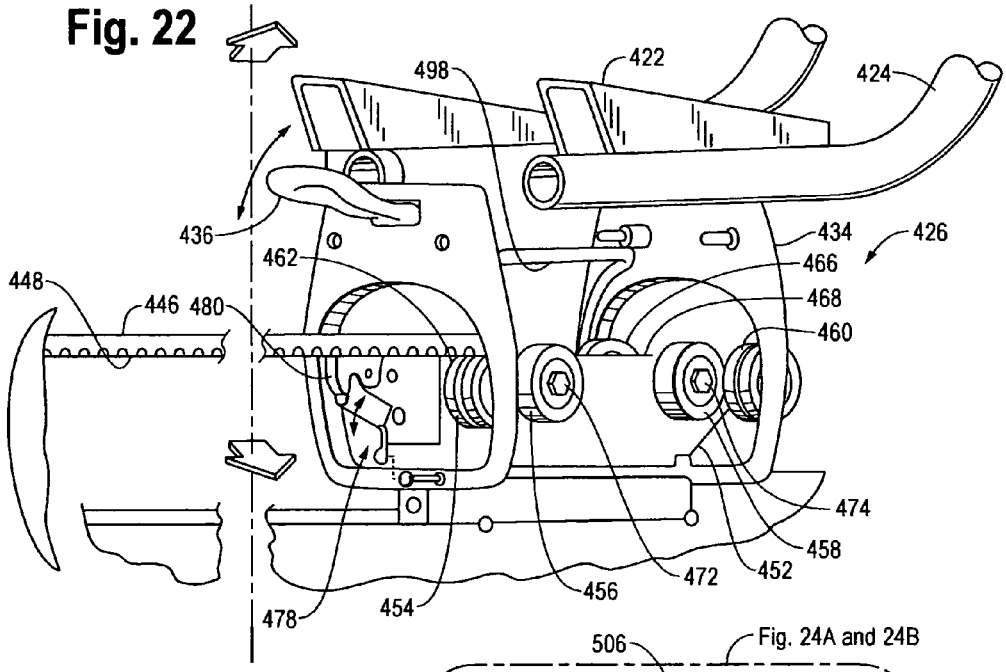
FIG. 22 is left perspective view of certain components of the seat mechanism of FIG. 21.

FIG. 22 is similar to FIG. 21 except that the carriage support member 428 has been removed showing details of some of the inner portions of the seat mechanism 426. Included is a rack 446 configured with a number of teeth 448 and secured to an upper inner surface 450 of the carriage support member 428 as illustrated in FIG. 26. A carriage 452 having a set of eight wheels 454-468 mounted for rotation on four axels 470-476 that are secured to the carriage 452. Also attached to the carriage 452 is a latch mechanism indicated at 478 that includes a pawl 480 having, in this embodiment, a pair of end projections 482 and 484 configured to engage the 448 in the rack 446.

Figure 23:
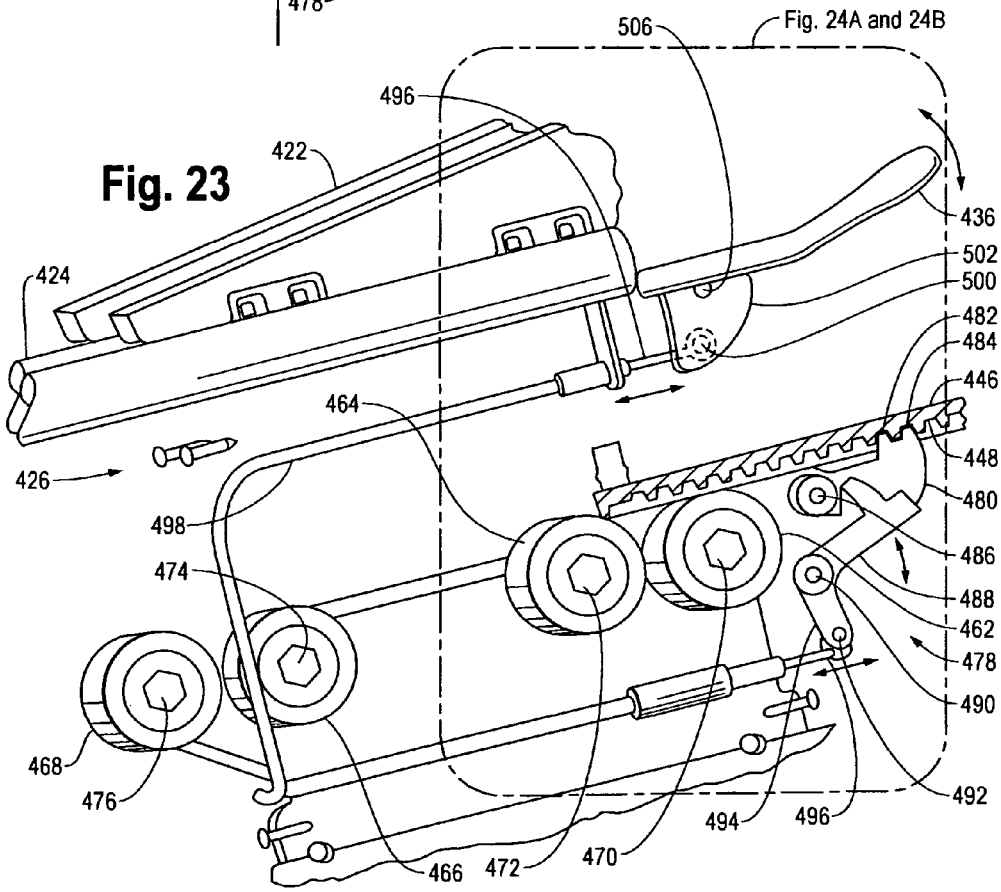
FIG. 23 is right perspective view of latch mechanism components of the seat mechanism of FIG. 21.

With reference to FIG. 23, which a sectioned right view of the latch mechanism 478 with the carriage 452 removed, the pawl 480 is pivotally attached to the carriage 452 by a shaft 486. Operatively engaged with the pawl 480 is a pawl retaining member 488 that is pivotally attached to the carriage 452 by a shaft or axel 490. Pivotally connected at a point 492 to a lower extension 494 of the pawl retaining member 488 is a cable 496 that runs through a tube 498 to a connection point 500 on a tab 502 that forms part of the release handle 436. The release handle 436 is rotationally attached to the carriage housing 430 via a bracket structure 504 at a pivot point 506.

Figure 24A:
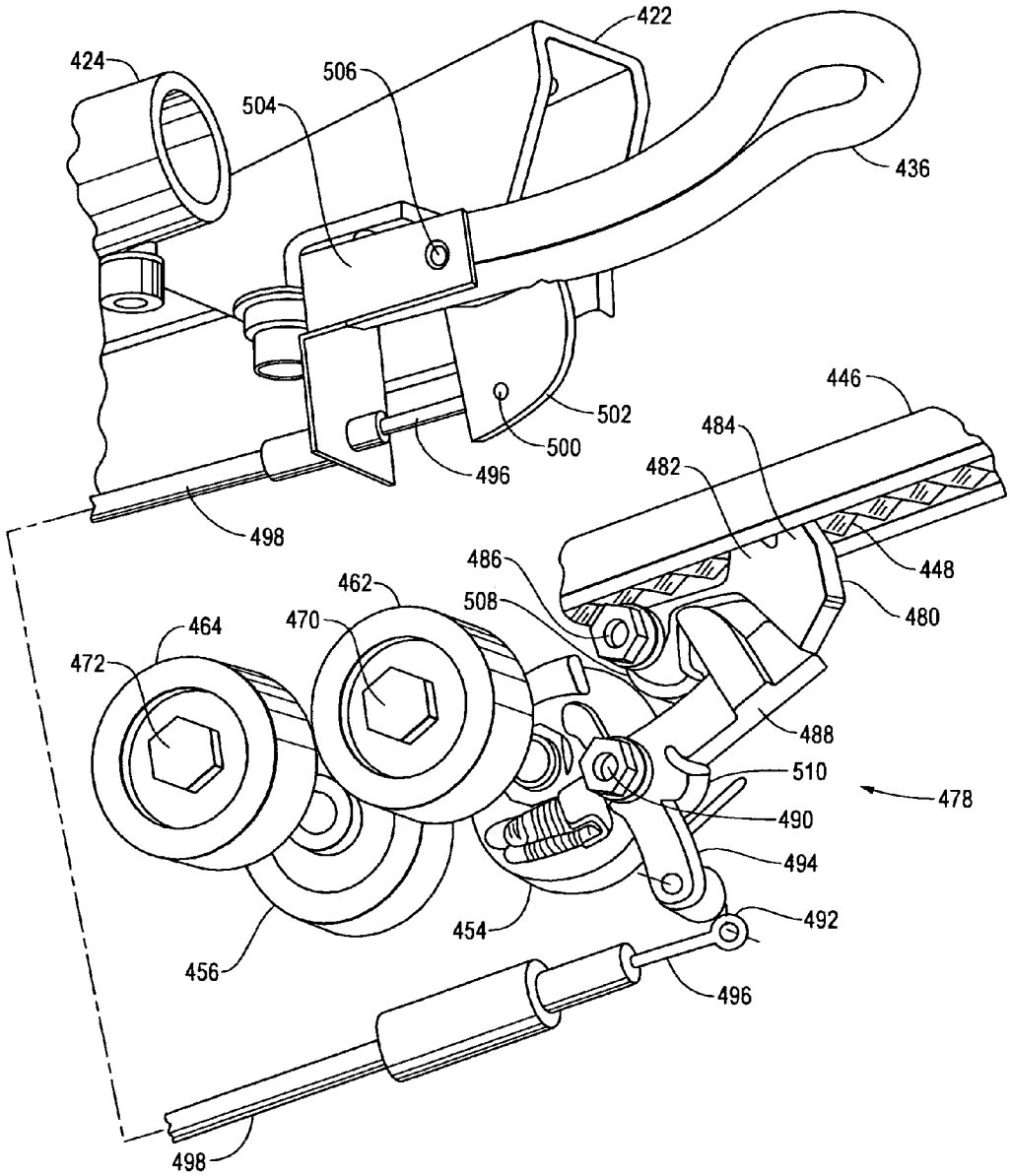
FIG. 24A and FIG. 24B are right expanded views illustrating the operation of latch mechanism of FIG. 23.
Figure 24B:
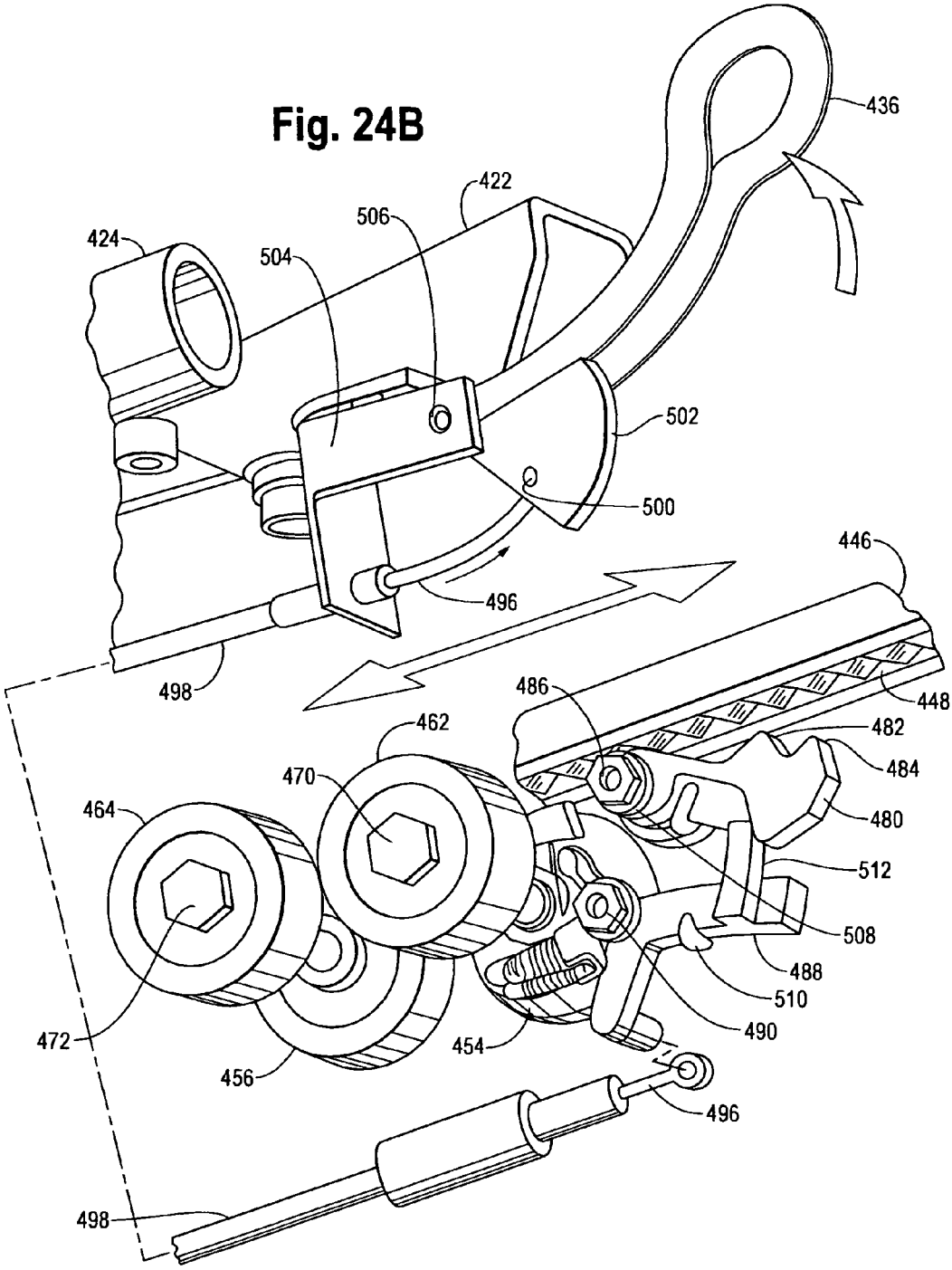

FIGS. 24A and 24B illustrate the operation of the latch mechanism 478. Normally the handle 436 will be in a lowered state as shown in FIG. 24A with the pawl 480 fully engaged with two of the teeth 448 on the rack 446. A biasing force tending to maintain the pawl 480 with the teeth 448 is provided by a torsion spring 508 and the pawl retaining member 488, which is biased upward by another torsion spring 510 provides a wedging force on the pawl 480 to aid in maintaining the pawl 480 engaged with the rack 446. This will prevent the carriage 452 and hence the seat from moving longitudinally along the carriage support member 428. As shown in FIG. 24B, an upward pull on the handle 436 by a user will be transmitted by the cable 496 to the pawl retaining member 488 causing it to rotate downwardly. As the pawl retaining member rotates a boss indicated by 512 on the retaining member 488 will also cause the pawl 480 in turn to rotate downwardly and disengage from the rack 446. At this point the carriage 452 is free to roll along the carriage support member 428 on the wheels 454-466 so as to allow the user to move the seat to a desired position. Releasing the handle 436 will result in the springs 508 and 510 causing the pawl 480 to lock the carriage 452 and hence the seat in place.

Figure 25:
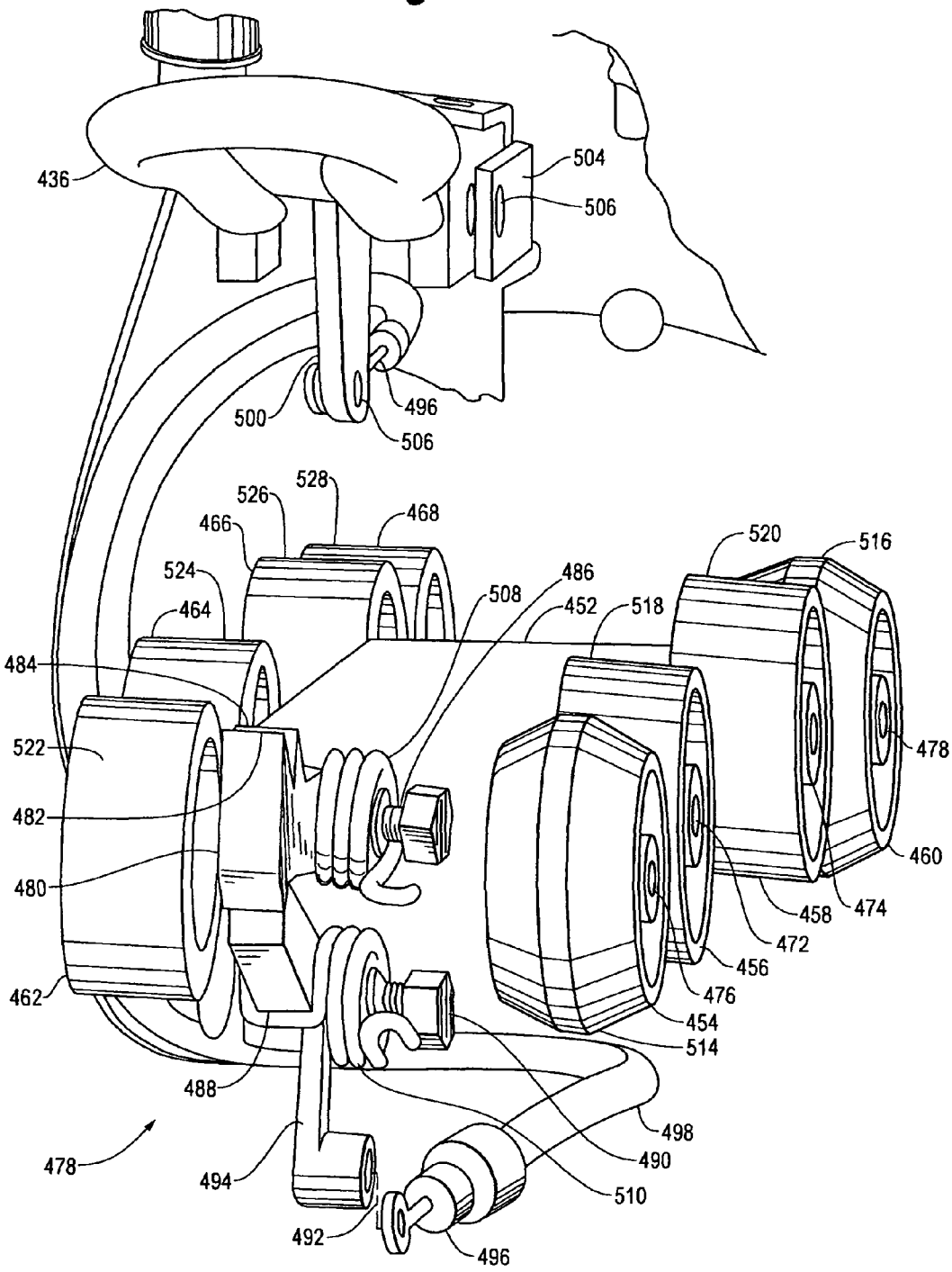
FIG. 25 is front perspective view of a portion of a carriage assembly for use with the seat mechanism of FIG. 21.

FIG. 25 depicts portions of the carriage 452 and the latch mechanism 478. In particular, FIG. 23 illustrates that the four center wheels 456, 458, 464 and 466 are raised in comparison with the four end wheels 454, 460, 462 and 468. Also, FIG. 25 shows that the outer surfaces of the first wheel 454 and the last wheel 460 on the left side of the carriage 452 are configure in a v-shape as indicated at 514 and 516. The remaining wheels 456, 458, 464 and 466 have flat outer surfaces as indicated at 518-528.

FIG. 26 provides a rear cross sectional view of the carriage support member 428. The carriage support member 428 is configured with a pair of upper tracks 530 and 532 having planar surfaces that provide a riding surface for the upper or middle wheels 456, 458, 464 and 466. On the lower left side, the carriage support member 428 is configured with a grooved track that provides a riding surface for the wheels 454 and 460 having the v-shaped outer surfaces 514 and 516. A track 538 having a planar surface that provides a riding surface for the lower wheels 462 and 468 is configured on lower right side of the carriage support member 428.

Also shown in FIG. 26 is the carriage housing 430 that encompasses the carriage support member 428. The carriage housing 430 is secured to a lower portion 540 of the carriage 452 by a set of fasteners, indicated at 542 that extend through a pair of brackets 544 and 546 integrated with the housing 430. The lower portion 540 of the carriage also extends through a slot, indicated by 548, configured in the bottom of the carriage support member 428 that extends along the length of the member 428. As a result the housing 430 can move along the carriage support member 428 with the carriage 452.

The preferred embodiment of the recumbent seat mechanism 426 as described above has a number of advantages. For example, the adjustable seat mechanism 426 encloses substantially all of its operating components within the carriage support member 428 and the carriage housing 430 thus reducing potential user interference. Also, the mechanical arrangement of the mechanism 426 permits the location of the release handle 436 forward and just below the seat, which is particularly convenient for users

We claim:

1. A method for moving and securing a seat in both a vertical and in a horizontal direction on a stationary exercise bicycle having a frame comprising the steps of:

lifting the seat, which is attached to a seat post that in turn is enclosed within a support tube secured to the frame, to a desired a first vertical position;

releasing the seat in said first vertical position wherein a first latch member is effective to engage one or more teeth of a rack configured within said support tube thereby being effective to secure the seat in said first vertical position;

lowering the seat to a second vertical position by upwardly lifting a handle portion of a first release handle rotatably connected to an upper portion of said seat post thereby causing a connecting rod, rotatably secured to said release handle and said first latch member, to move resulting in the disengagement of said first latch member from said teeth of said rack thereby permitting said seat to move downwardly to said second vertical position;

releasing said handle portion resulting in a biasing member secured to said first latch member to cause said first latch member to re-engage said teeth thereby being effective to secure said seat in said second vertical position;

moving the seat from a first to a second horizontal position by first lifting a handle portion of a second release handle, that is rotatably connected to a pawl as well as rotatably secured to a slidable seat support member, to disengage said pawl from one or more upwardly extending teeth on a second rack secured to the seat post;

sliding said slidable seat support member that is slidably engaged to said seat post from the first to the second horizontal position; and releasing said handle portion of said second release handle resulting in said pawl re-engaging said teeth of said second rack thereby being effective to secure said seat in said second horizontal position.

2. The method of claim 1 wherein said first release handle extends outwardly in a first horizontal direction forward from said seat post and said step of lowering said seat to a second vertical position includes reaching forward to lift said handle portion.

3. The method of claim 2 wherein said second release handle extends outwardly in a second horizontal direction rearwardly from said seat post and said step of moving said seat to a second horizontal position includes reaching rearwardly to lift said handle portion.

4. The method of claim 1 wherein said slidable seat support member is configured with at least one substantially horizontal slide member and a receiving member secured to said seat post is configured to receive said slide member and said step of moving said seat to a second horizontal position includes moving said slide member horizontally within said receiving member.

5. The method of claim 4 wherein said slide member is configured with a generally circular cross section and said receiving member is configured with a generally tubular member to receive said slide member to permit said step of horizontal movement.

* * * * *